US009938591B2

(12) United States Patent
Correia Alves et al.

(10) Patent No.: US 9,938,591 B2
(45) Date of Patent: Apr. 10, 2018

(54) METHOD FOR CARBONATION

(71) Applicant: L'Air Liquide, Societe Anonyme pour l'Etude et l'Exploitation des Procedes Georges Claude, Paris (FR)

(72) Inventors: Carlos Alberto Correia Alves, Lagoinha-Palmela (PT); Arnaldo Manuel Estima De Oliveira Araujjo, Lisbon (PT)

(73) Assignee: L'AIR LIQUIDE SOCIETE ANONYME POUR L'ETUDE ET L'EXPLOITATION DES PROCEDES GEORGES CLAUDE, Paris (FR)

( * ) Notice: Subject to any disclaimer, the term of this patent is extended or adjusted under 35 U.S.C. 154(b) by 0 days.

(21) Appl. No.: 14/713,840

(22) Filed: May 15, 2015

(65) Prior Publication Data

US 2015/0329924 A1 Nov. 19, 2015

(30) Foreign Application Priority Data

May 16, 2014 (EP) ..... 14398004

(51) Int. Cl.
*C13B 20/06* (2011.01)

(52) U.S. Cl.
CPC ..... *C13B 20/06* (2013.01)

(58) Field of Classification Search
CPC ..... C13B 20/06
See application file for complete search history.

(56) References Cited

U.S. PATENT DOCUMENTS

| | | | | |
|---|---|---|---|---|
| 2,164,186 | A * | 6/1939 | Brown | C13B 20/06 127/50 |
| 6,176,935 | B1 | 1/2001 | Brahmbhatt | |
| 2005/0229813 | A1* | 10/2005 | Dionisi | C13B 20/02 106/162.1 |
| 2010/0043783 | A1* | 2/2010 | Frenzel | C13B 20/06 127/11 |

FOREIGN PATENT DOCUMENTS

| | | | |
|---|---|---|---|
| EP | 0 635 578 | | 1/1995 |
| GB | 1 106 276 | | 3/1968 |
| GB | 1 239 407 | | 7/1971 |
| WO | WO 2008/089946 | * | 7/2008 |

OTHER PUBLICATIONS

Static Mixers in the Process Industries—A Review R.K. Thakur et al. Trans. IChemE. vol. 81, Part A, pp. 787-826, 2003.*
EP Search Report for EP 14398004.3, dated Oct. 22, 2014.

* cited by examiner

*Primary Examiner* — Douglas B Call
(74) *Attorney, Agent, or Firm* — Christopher J. Cronin

(57) ABSTRACT

The present application discloses a method for carbonation with $CO_2$. The method now disclosed describes the use of a static or dynamic mixer to react the $CO_2$ with the incoming of nation liquor to whom $Ca(OH)_2$ was previously added and readily starts the precipitation of tiny carbonate crystals. This solution can be advantageously used to compensate the deficit of $CO_2$ in the carbonation process. This method for carbonation can be applied for example in the sugar refining industry.

11 Claims, 1 Drawing Sheet

METHOD FOR CARBONATION

CROSS-REFERENCE TO RELATED APPLICATIONS

This application claims the benefit of priority under 35 U.S.C. § 119 (a) and (b) to EP patent application No. 14398004.3, filed May 16, 2014, the entire contents of which are incorporated herein by reference.

BACKGROUND

Field of the Invention

The present application discloses a method for carbonation with $CO_2$, which can be applied as example in the sugar refining.

Related Art

The word "sugar" is currently used for the chemical sucrose. Sucrose is a member of a group of substances generally known as sugars, which contain up to ten monosaccharide units, wherein monosaccharides are carbohydrates that cannot be further hydrolyzed. All carbohydrates are compounds built up from the elements carbon, hydrogen and oxygen. All sugars are crystalline, water soluble and sweet tasting.

Sucrose has the chemical formula $C_{12}H_{22}O_{11}$. It may be converted by acid or enzymatic hydrolysis into a mixture of two sugars, glucose and fructose, each with the formula $C_6H_{12}O_6$, through the following general reaction:

$$C_{12}H_{22}O_{11}H_2O \rightarrow C_6H_{12}O_6 + C_6H_{12}O_6$$

In sugar refining, glucose and fructose are regarded as impurities due to the difficulty of crystallizing them from the solution. Due to this, strict control of pH must be maintained to avoid loss of sucrose during refining through chemical hydrolysis to glucose and fructose.

Sucrose is purified from raw sugar, which is about 97.5% sucrose, in a four step process comprising the following steps:

- affination—dissolving off some surface impurities;
- carbonation—removing further impurities that precipitate from solution with calcium carbonate;
- char filtration—removing further impurities with activated carbon;
- crystallization—using a heat/vacuum process to produce sugar crystals.

In carbonation, milk of lime, which is calcium hydroxide, is added to the heated liquor, and boiler flue gas, containing $CO_2$, is bubbled through the mixture. The chemical reaction $$Ca(OH)_2 + CO_2 \rightarrow CaCO_3 + H_2O$$

occurs under controlled conditions and as the calcium carbonate precipitate is formed, it precipitates a number of impurities, including multivalent anions such as phosphate, sulfate and oxalate, and large organic molecules such as proteins and pectins which aggregate in the presence of multivalent cations, removing them from the sugar syrup. The carbonation process is carried out in two stages, namely, two stages of carbonation with flue gases containing $CO_2$ in tanks by bubbling the flue gases in the liquor to obtain an optimum quality precipitate for filtration, i.e. a suitable size and distribution of precipitate particles. The temperature of liquor shall be maintained between 70° C. and 90° C. by injecting steam in an exchanger built in each tank.

Eighty to ninety percent of precipitation is sought in the first stage of carbonation. The second stage is controlled by the measurement of the pH of the solution which is important throughout the process and ensures complete precipitation of the lime. The total reaction time is around 1 to 1.5 h at around 80° C.

The pH of liquors is of considerable importance. Below pH 7, sucrose is hydrolyzed to glucose and fructose, while above pH 9, alkali destruction of sugars occurs and coloured components are formed.

The calcium carbonate precipitate, including the impurities, is removed in a pressure filtration step using a filter cloth as supporting media and utilizing the calcium carbonate as a filter aid. The filter mud is later subjected to water washing to remove sugar residual and this mud is treated as a waste material. Water containing sugar recovered by washing the mud is used for dissolving the raw sugar at an earlier stage.

This operation of carbonation can be performed by flue gases containing $CO_2$ from the sugar mill boilers. By doing this, the calcium hydroxide added to the sugar liquor precipitates as $CaCO_3$ and reduces the impurities in the sugar syrup prior to crystallization. Yet there is a very important drawback: the $CO_2$ contained in the flue gases depends on the quantity and quality of the fuel being burned. Additionally the flue gases must be washed in a scrubber system to remove solid particles, SOx and NOx and this system produces liquid effluents that must be treated externally. Furthermore the flue gas is compressed using liquid ring compressors that use a high amount of electricity. The most common fuel used in the boilers, used to be fuel oil which produced flue gases with a content of ~12% $CO_2$. Yet, in present times due to environmental concerns, fuel oil is increasingly being substituted for natural gas which produces a flue gas with 6% $CO_2$. In some cases, sugar mills are stopping the boilers and installing combined cycle systems which have the advantage of producing electricity as well as steam but produce a flue gas with 2~3% $CO_2$. In these two events the quantity of $CO_2$ generated is not sufficient for the carbonation process and mills are known to partially change a part of the natural gas used by fuel oil only to increase the $CO_2$ content of the flue gas.

The document U.S. Pat. No. 6,176,935 discloses a system where flue gases from a boiler are first scrubbed and then passed through a gas separation membrane module. After the gas has passed through the membrane module, the concentration of carbon dioxide in the stream is increased to about 20% in volume. This stream is then injected into a reactor containing raw sugar, to perform the step of carbonation, and thus to remove most of the coloring matter from the raw sugar. However, this document does not disclose the use of a static or dynamic mixer to react with the $CO_2$ in a carbonation step.

The document EP0635578 discloses a method of refining brown sugar that comprises a step of carbonation and/or phosphatation of said brown sugar.

However, this document does not disclose the use of a static or dynamic mixer to react with the $CO_2$ in a carbonation step.

The document GB1239407 discloses a process for producing aragonite comprising the reacting carbon dioxide with calcium hydroxide dissolving in a sucrose solution at a temperature from 60° C. to 90° C. in the absence of crystal poisons in amounts preventing the formation of said aragonite. However, this document does not disclose the use of a static or dynamic mixer to react with the $CO_2$ in a carbonation step.

The document GB1106276 discloses a method of refining a raw sugar juice comprising initial defecation-saturation with simultaneous addition of some of the total required quantity of lime and carbon dioxide in a low alkaline pH range between 8 and 10. However, this document does not disclose the use of a static or dynamic mixer to react with the $CO_2$ used in a carbonation step.

SUMMARY OF THE INVENTION

The present application discloses a method for carbonation comprising the following steps:

The affination liquor and the $Ca(OH)_2$ are mixed on a first mixed vessel;

$CO_2$ is added to the mixture obtained on the previous step;

The mixture is passed through a mixer;

the mixture is sent to at least one carbonator where flue gas containing $CO_2$ is injected;

the mixtures are then sent to a second stage with at least one carbonator where the mixture is once again injected with flue gas containing $CO_2$;

the liquor obtained proceeds to filtration.

In an embodiment, the $CO_2$ used in the method is pure.

In another embodiment, the $CO_2$ used in the method is impure.

In even another embodiment, the mixture of $Ca(OH)_2$ with the affination liquor used in the method comprises between 0.6 to 0.8% of $Ca(OH)_2$.

In an embodiment, the residence time of the mixture in the first mixed vessel used in the method is lower than two minutes.

In another embodiment, the mixer used in the method is static or dynamic.

In even another embodiment of the method, the pH when the mixture passes through the mixer is comprised between 9.6 and 10.3.

In an embodiment of the method, the mixture on the first step of injection of $CO_2$ is sent to three carbonators.

In another embodiment of the method, the first stage of injection of $CO_2$ is made until the pH reaches 9.5.

In even another embodiment of the method, the second step of injection of $CO_2$ is made until the pH reaches between 8.0 and 8.5.

In an embodiment of the method, it is added a food grade flocculent.

In another embodiment of the method, the food grade flocculent is hydrolyzed polyacrylamide.

The present application discloses also the method for sugar refining comprising the method for carbonation described.

BRIEF DESCRIPTION OF THE FIGURES

The following figures provide preferred embodiments for illustrating the description and should not be seen as limiting the scope of invention.

DETAILED DESCRIPTION OF THE INVENTION

Figure 1:
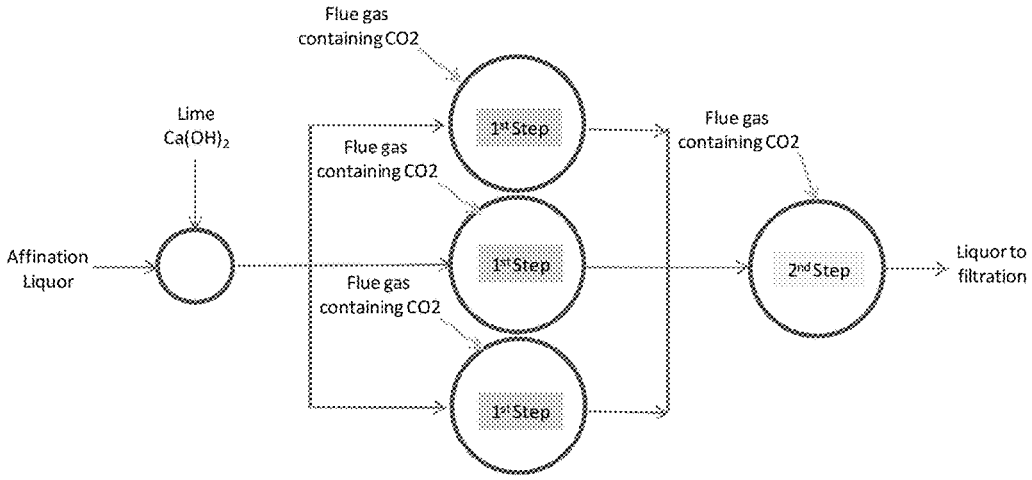
Figure 1 Prior Art
FIG. 1 is a schematic of a typical carbonation system including two stages using flue gas from boilers.
Figure 2:
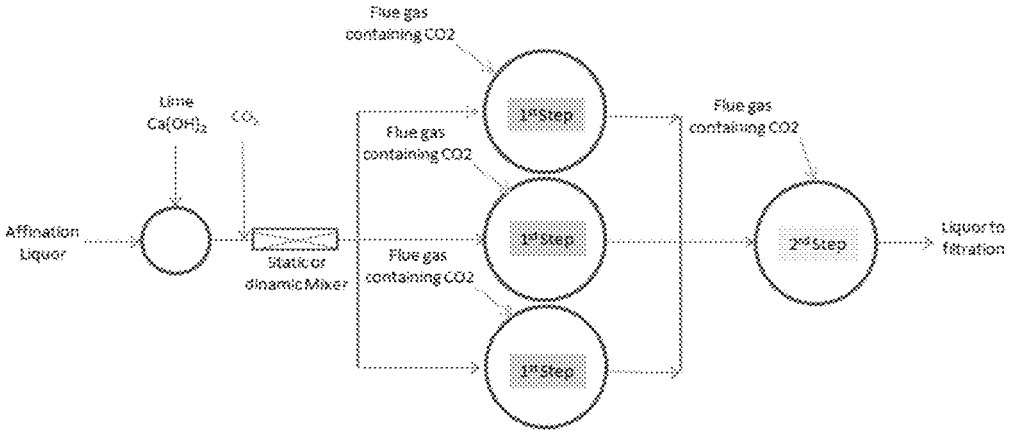
FIG. 2 is a schematic of the inventive carbonation system.

The present application describes a method for carbonation with $CO_2$, which can be applied as example in the sugar refining.

In this method, pure $CO_2$ or mixtures of $CO_2$ can be used advantageously to compensate the deficit of $CO_2$ in the carbonation process, due to the fact that there is sometimes low concentration $CO_2$ in the flue gases. This will allow the sugar mill to fine tune the process regarding $CO_2$ balance and will bring carbonation back into control.

The $CO_2$ used can be pure or impure, for instance coming from a $CO_2$ tank or from the flue gases of any of the boilers or a lime kiln or a $CO_2$ concentration device, for example amine scrubber, membranes, etc.

There are three ways to introduced $CO_2$ in the process in order to achieve this goal:

1. in the flue gases;
2. in either stages of the carbonation;
3. in the liquor before the carbonation process and after $Ca(OH)_2$ addition.

Option 1 will be limited by the efficiency of carbonation, which is very poor since flue gases contain about 90% inert gases and the bubbling system inside creates very coarse bubbles which will create the stripping of the $CO_2$ added to the flue gas. In option 2, it is possible to consider adding $CO_2$ inside the carbonators via a recirculation loop with a pump and a static mixer—however the $CO_2$ will have to be added at a pH lower than the incoming liquor to carbonation and as soon as the recirculating liquid is sent again to the carbonator, stripping will occur—thus reducing the efficiency of carbonation.

The method now disclosed describes the use of option 3 as it uses a static or dynamic mixer to react the $CO_2$ with the incoming affination liquor to whom $Ca(OH)_2$ was previously added and readily starts the precipitation of tiny carbonate crystals. Thus the yield of use of $CO_2$ will be very high, even if the crystals formed are very small, i.e. the crystals have a dimension smaller than the filter holes diameter.

If impure $CO_2$ is used, the inert gases contained will not react with $Ca(OH)_2$ even after the mixer. In this case the inert gas bubbles will continue in the liquor current and will be degassed in the carbonators.

The next stages of carbonation will be preferably conducted with flue gases inside the carbonators—so that higher residence time and lower partial pressure of $CO_2$ will let calcium carbonate crystals continue to grow and thus entrap more of the liquor impurities. For lower partial pressure of $CO_2$ on this application it is understood that it is a pressure between 6 KPa and 12 KPa.

This crystal growth is critical to get a good filterability of the liquor. If needed, a food grade flocculent like for instance an acrylamide-acrylic acid resin, such as for example hydrolyzed polyacrylamide, can be added to increase the aggregation of the crystals and improve filterability.

By this proposed way the sugar mill will be much less dependent on the availability of $CO_2$ containing flue gases and can adapt the carbonation process to the amount of impurities present in the raw sugar. This will mean that the industrial can add higher amounts of $Ca(OH)_2$ if he needs to remove more impurities, since this higher amount will be compensated by the "extra" $CO_2$ added after $Ca(OH)_2$ addition.

The method comprises the following stages:

Mixture of the affination liquor and the $Ca(OH)_2$, which can be comprised between 0.6 to 0.8% of $Ca(OH)_2$ as CaO is added on liquor solids, in a first agitated vessel; At this point, the pH of the mixture is higher than 11. At this high pH, occurs degradation of the hexoses present, to degradation products of strong colour. In order to avoid this degradation reaction, residence time in the vessel must be reduced to less than 2 minutes;

$CO_2$ is added to the mixture obtained on the previous step;

The mixture is passed through a static or dynamic mixer in order to promote the carbonation reaction between the $CO_2$ with the lime till a pH comprised between 9.6 and 10.3 obtained;

the mixture can be divided in more than one first stage carbonators, where flue gas containing $CO_2$ is injected and bubbled through the mixtures till a pH of 9.5;

the mixtures are then sent to a second stage with at least one carbonator where the mixture is once again injected with flue gas containing $CO_2$ till a pH of 8.5 to 8.0;

the liquor obtained proceeds to filtration.

The $CO_2$ is added just before the mixer, since the pH of the mixture is higher on that moment, more than 11, which favours a fast and complete reaction of CO2 with $Ca(OH)_2$, in comparison with the first step of carbonation with injection of flue gas containing $CO_2$, where the pH is approximately 9.5, and the second step of carbonation with injection of flue gas containing $CO_2$ where the pH is approximately 8.5 to 8.0.

The technology is of course not in any way restricted to the embodiments described herein and a person of ordinary skill in the area can provide many possibilities to modifications thereof as defined in the claims.

The preferred embodiments described above are obviously combinable. The following dependent claims define further preferred embodiments of the disclosed technology.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A method for carbonation comprising the following steps:

mixing affination liquor and $Ca(OH)_2$ on a first mixed vessel to provide a first mixture containing affination liquor and $Ca(OH)_2$, wherein a residence time in the first mixed vessel is less than 2 minutes;

adding $CO_2$ to the first mixture coming out of the first mixed vessel to provide a second mixture;

feeding the second mixture to a static or dynamic mixer to mix the second mixture therein, wherein the static or dynamic mixer is fluidly connected to the first mixed vessel;

downstream of the static or dynamic mixer, sending the second mixture to at least one first carbonator where flue gas containing $CO_2$ is injected thereinto, wherein the static or dynamic mixer is fluidly connected to the at least one first carbonator;

downstream of said at least one first carbonator, sending the second mixture to at least one second carbonator where flue gas containing $CO_2$ is injected thereinto to obtain a filtration liquor; and filtering the filtration liquor.

2. The method of claim 1, wherein the $CO_2$ used for providing the second mixture is pure.

3. The method of claim 1, wherein the $CO_2$ used for providing the second mixture is impure.

4. The method of claim 1, wherein the first mixture contains between 0.6 to 0.8% of $Ca(OH)_2$ by weight.

5. The method of claim 1, wherein a residence time of the first mixture in the first mixed vessel is lower than two minutes.

6. The method of claim 1, wherein the pH of the first mixture is between 9.6 and 10.3.

7. The method of claim 1, wherein said at least one carbonator comprises three carbonators and flue gas containing $CO_2$ is injected into each of the three carbonators.

8. The method of claim 1, wherein flue gas containing $CO_2$ is injected into said at least one first carbonator until a pH therein first reaches 9.5.

9. The method of claim 1, flue gas containing $CO_2$ is injected into said at least one second carbonator until a pH therein first reaches 8.0-8.5.

10. The method of claim 1, wherein a food grade flocculent is added to the first or second mixture or to the filtration liquor.

11. The method of claim 10, wherein the food grade flocculent is hydrolyzed polyacrylamide.

* * * * *